United States Patent [19]

Watanabe et al.

[11] Patent Number: 4,782,977

[45] Date of Patent: Nov. 8, 1988

[54] TAMPER RESISTANT CONTAINER

[75] Inventors: Gary Watanabe, Redondo Beach; Johnson N. S. Wong, Rolling Hills, both of Calif.

[73] Assignee: Evergreen Industries, Inc., Los Angeles, Calif.

[21] Appl. No.: 133,578

[22] Filed: Dec. 16, 1987

[51] Int. Cl.[4] ..... B65D 45/16

[52] U.S. Cl. ..... 220/324

[58] Field of Search ..... 220/4 B, 306, 307, 324

[56] References Cited

U.S. PATENT DOCUMENTS 3,767,110 10/1973 Congleton ..... 220/324

4,684,024 8/1987 Ebrahim et al. ..... 220/324

*Primary Examiner*—George T. Hall

*Attorney, Agent, or Firm*—Nilsson, Robbins, Dalgarn, Berliner, Carson & Wurst

[57] ABSTRACT

A container defined by a base and cover, with the cover being formed to fit upon the base. The base and lid are formed so that when fitted together at least one wall of each overlaps a wall of the other. The overlapping walls are formed with an aperture which become aligned when the cover and base are fitted together. The container further includes a fastening hasp attached to either the cover or the base. One end of the hasp end is formed to pass through the aligned apertures in only one direction. Once the hasp end is positioned through the aligned aperture any attempt to remove the hasp therefrom brings a portion of the hasp into contact with the wall defining the aperture. This prevents the removal of the hasp from the aligned apertures. The hasp is further formed with a tab which can be grasped and pulled causing the hasp to tear along a pre-scored line.

22 Claims, 3 Drawing Sheets

FIG. 1
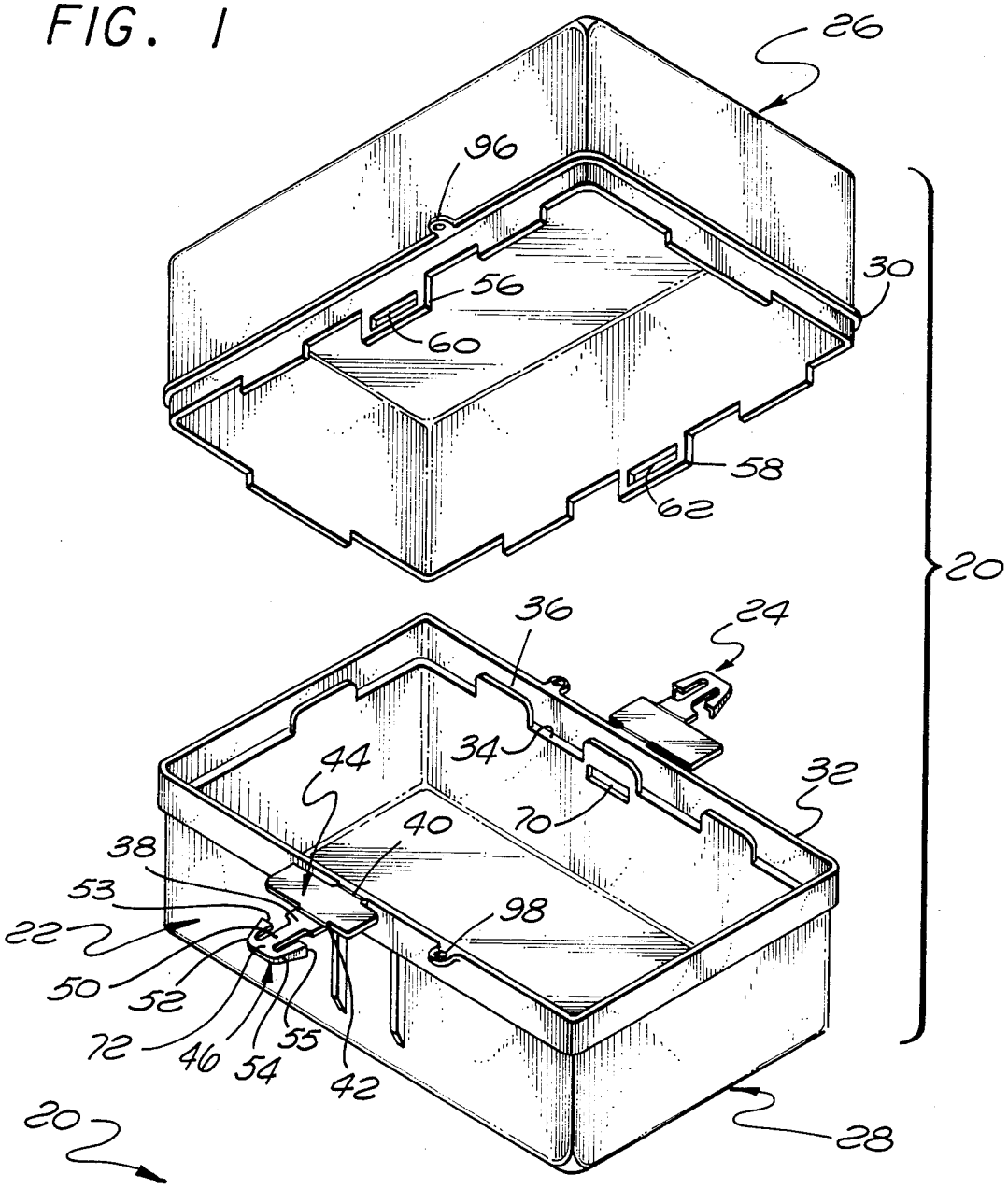
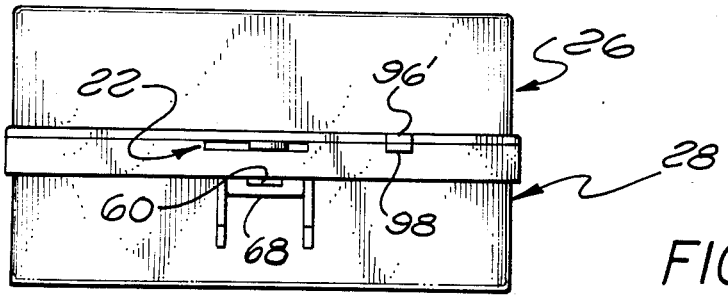
FIG. 2

FIG. 3
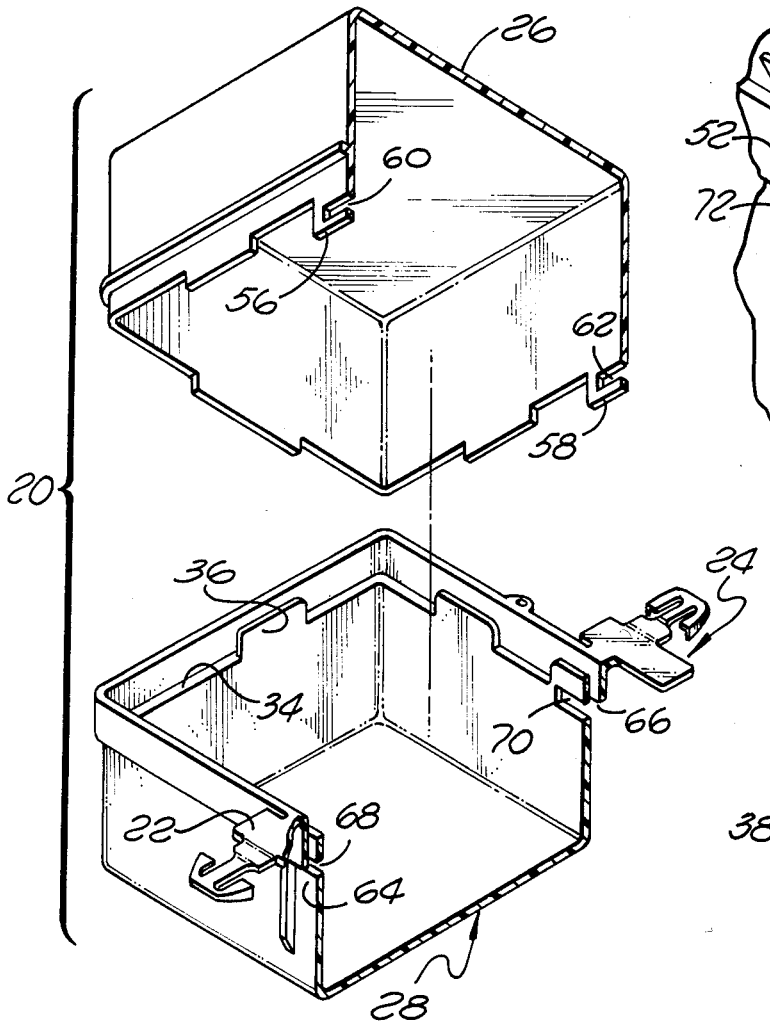
FIG. 4A
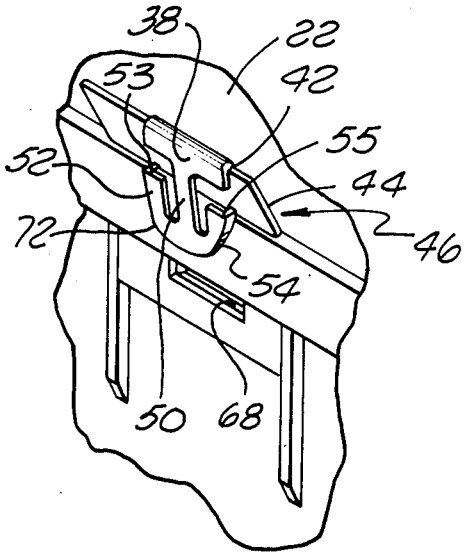
FIG. 4B
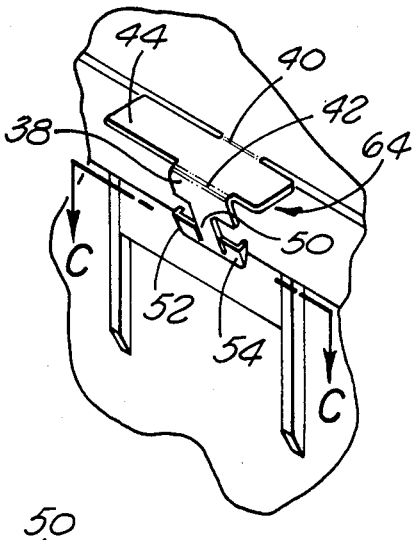
FIG. 4C
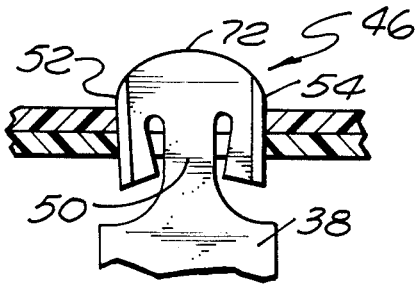
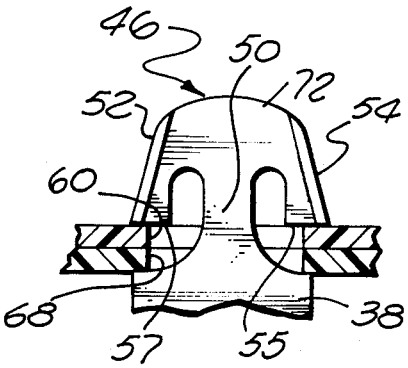
FIG. 4D FIG. 5
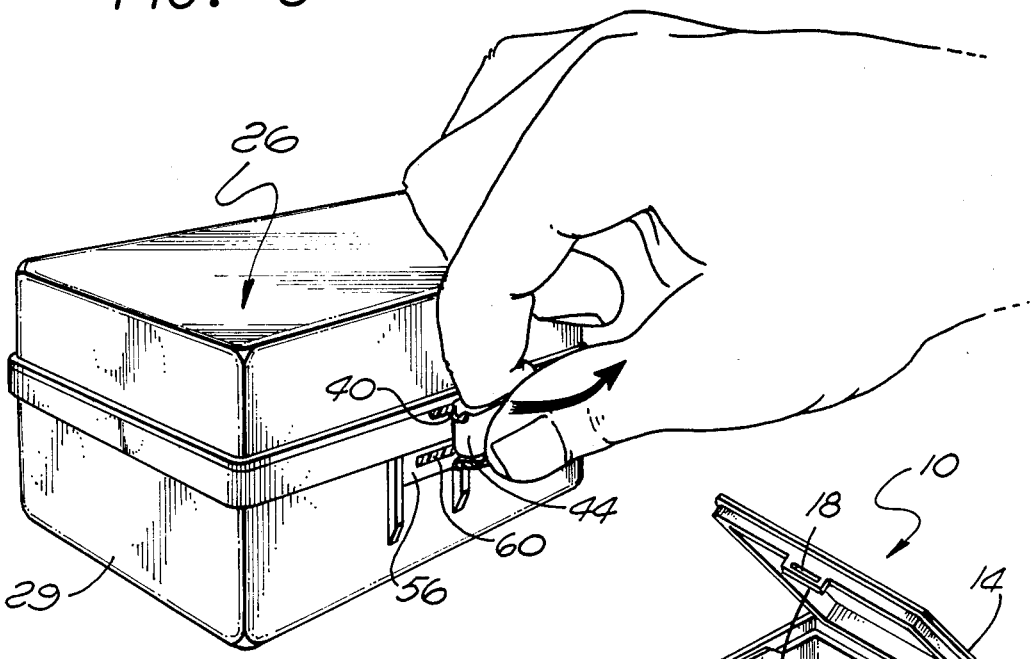
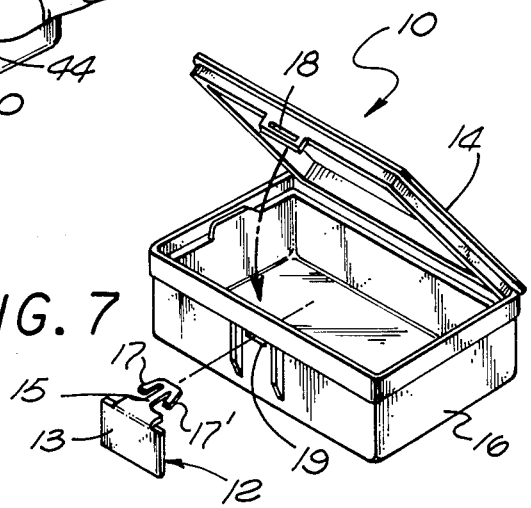
FIG. 7
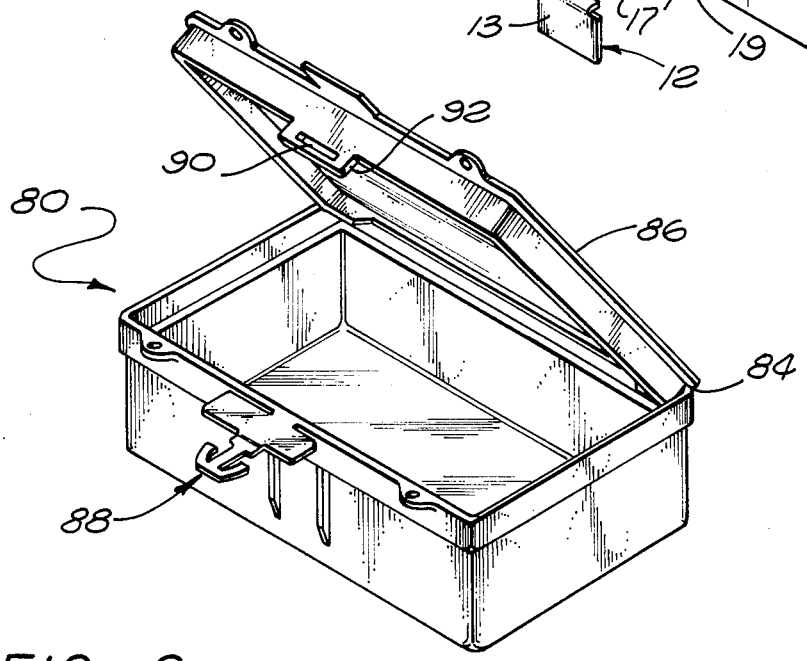
FIG. 6

TAMPER RESISTANT CONTAINER

BACKGROUND OF THE INVENTION

The present invention is directed to the field of containers and specifically to the field of tamper resistant containers.

The use of tamper resistant containers is not only desirable but essential in certain applications. In particular, the sealing of containers in a manner to resist tampering with the contents, or at least provide a mechanism where any tampering will be readily apparent, is critical in those applications where there is a need to maintain the chain of custody of such contents. This usually requires that the container be sealed in a manner which would minimize accessibility to the contents, or at least visually indicate if such access has been obtained.

The use of tamper resistant containers is particularly important in the fields of medical and criminal investigations, where maintaining the chain of custody is of paramount importance. For example, in criminal investigations the testing of substances to determine whether the same is a controlled substance requires that the identity of the substance be reliably maintained throughout the testing and storage of such substance.

This maintenance of the chain of custody is especially important when the substance and its identity is to become a matter of record at trial. Thus the substance must be held in a container which minimizes the possibility, or at least reliably evidences tampering with the contents.

The use of such tamper resistant containers is also important in the field of medical investigations. For example, the identity of blood/urine samples which are being tested for various infectious diseases and/or chemicals must be maintained in order to ensure that the specimen remains as collected. This allows for a confirmation of the reliability of the test procedures, and is especially necessary in order to ensure that the particular individual from which the blood and/or urine is taken can be properly identified. Thus it is necessary to maintain such specimens in a tamper resistant container. The importance of the reliability in medical testing has recently gained particular importance with such testing being conducted as part of employment programs.

Another important application for tamper resistant containers is the use for storage or transportation of medical specimens which may include infectious diseases. For example, when transporting blood samples which are to be tested for the AIDS virus it is desirable to maintain the integrity of the individual specimens and also to prevent accidental contact with the specimens. A tamper resistant container will ensure not only the integrity of the specimens, but will also minimize unwarranted contact with the specimens contained therein.

Presently available tamper resistant containers are fastened shut using wire or plastic ties. For example, a container constructed from two halves includes eyelets formed along a common side of each container half which are aligned when the container is shut. Individual ties are then wrapped through the aligned eyelets with their respective ends being sealed together using material, e.g. a piece of wax or solder. The container can only be opened by breaking the seal holding the wire or plastic tie together, which is easily detected.

Other presently available containers are formed with a one way insertable plugs which snap through apertures formed in each of the container halves. That is, each half of the container is formed with separate apertures which will be aligned after the container is closed. The plugs are typically formed to easily fit through the apertures but cannot be removed therefrom.

An example of such a container with a plug is seen in FIG. 7, generally at 10. The plug 12, includes first and second halves which are disposed at ninety degrees to one another. The first half, seen at 13, is a flat rectangular body, with the second half formed with a central stem which extends out from the rectangular body. This central stem 15 has integrally formed from two opposite sides individual prongs 17 and 17'.

These prongs 17 and 17' extend from a common end with the central stem 15 and project therefrom in a direction generally parallel to the central stem 15 and to each other. These prongs 17 and 17' are formed with an outer edge which angles outward from the common end away from the central stem. The construction of the second half in this manner allows for the movement of the prongs 17 and 17' towards the central stem 15 by applying pressure against the outer edges of each prong 17 and 17'. After this applied pressure is removed the prongs 17 and 17' move freely in the opposite direction away from the central stem 15. This re-positions the prongs 17 and 17' in the original positions with respect to the central stem 15.

The container 10 includes a cover section 14 and base section 16 which are each formed with at least first apertures 18 and 19 which are brought into alignment when the cover 14 is fitted onto the base 16. By pushing the second half of the plug 12 through the aligned apertures 18 and 19, the prongs 17 and 17' are moved inward. That is, as the two outer edges of the prongs 17 and 17' slide along the sides of the apertures 18 and 19 the angular relationship of these outer edges exerts the necessary pressure against such edges. This pressure causes the prongs 17 and 17'to move inward towards the central stem 15, thus allowing the passage of the second half through the apertures 18 and 19.

Once passed through the apertures 18 and 19 these prongs 17 and 17' return to their original positions preventing the removal from such apertures 18 and 19. When entry is desired into the container 10 the first half of plug 12 is broken away from the second half. This is accomplished by forming the plug 12 from a relatively brittle material which is easily broken. This breakage is easily observed and indicates the possibility of tampering with the contents.

Another application for which tamper resistant containers may be useful are those applications wherein child resistant caps are now presently being used. That is, certain containers are provided with caps or covers which require a specific manipulation to allow removal. In place of constructing each individual container with a child resistant cover, a multiple number of such containers can be inserted with a box like container which is secured in the manner discussed above. This would provide the desired child resistance afforded by the individual container covers at a lesser expense.

While the above discussed containers do provide for a degree of resistance to tampering, or at least minimize undetected tampering, these containers do have some limitations. In particular, it has been found that both the wire and plastic ties and insertable plugs can be removed and replaced with an identical tie or plug without any detectable difference. Thus the contents can be tampered with without detection. This defeats the very reason for using such containers.

SUMMARY OF THE INVENTION

The present invention overcomes the above discussed disadvantages by permanently attaching a fastening hasp to a container. This fastening hasp is permanently attached at a first end to such container. A second end of this hasp is formed to allow one-directional insertion through aligned apertures formed in contiguous wall portions of the container cover and base.

More specifically, the container of the invention is a box-like structure defined by a base and cover, with the cover being formed to fit upon the base. The base and lid are formed so that when fitted together at least one wall of each overlaps a wall of the other. The overlapping walls are formed with an aperture which become aligned when the cover and base are fitted together.

The fastening hasp is attached to either the cover or the base. That hasp end which is formed to pass through the apertures includes two prongs which extend out from the opposing sides of the hasp end. These prongs angle back away from the hasp end and outward away from the hasp. The hasp prongs will move towards the hasp by applying pressure against their outer sides. When the hasp end is pushed through the apertures, with at least one of the apertures being narrower than the width across the prongs, these prongs are moved inwards towards the hasp. Once though the apertures these prongs return to their original positions preventing removal therefrom.

In order to gain access into the container the fastening hasp is further formed with a tab which can be grasped and pulled to sever the flexible body from the point of permanent attachment to the container. To facilitate this severance the hasp body is preferably scored along its width. This scoring is formed to tear away when the hasp tab is pulled in a given direction.

BRIEF DESCRIPTION OF THE DRAWINGS

The present invention may be better understood and its advantages will be apparent to those skilled in the art by reference to the accompanying drawings, wherein like reference numerals refer to like elements in the several Figures, and wherein:

FIG. 1 is an exploded perspective view of a box including a sealing fastening hasp in accordance with an embodiment of the invention;

FIG. 2 is a front elevational view of the box of FIG. 1;

FIG. 3 is an exploded section view of the box of FIG. 1;

FIGS. 4 A–D are various illustrations of the operation of an fastening hasp in accordance with an embodiment of the invention;

FIG. 5 is an illustration of the removal of the fastening hasp shown in FIGS. 4 A–D;

FIG. 6 is a perspective view of a box including a sealing fastening hasp in accordance with another embodiment of the invention; and FIG. 7 is a perspective view of a prior art box arrangement.

DESCRIPTION OF THE INVENTION

The present invention is directed to a tamper resistant container. In particular, the present invention is directed to a container defined by a base and cover, with a fastening hasp attached to either the base or cover. This fastening hasp is formed to securely lock the container closed in a tamper resistant manner. In particular, the fastening hasp of the invention is designed with an end having opposing prongs which can be pinched against the hasp by the proper application of pressure against the outer edges of the prongs.

The container is formed such that when the base and cover are fitted together at least one wall of the base is positioned adjacent to one wall of the cover. Each of these adjacent walls are formed with apertures which become aligned when the cover and base are fitted together. The free end of the hasp is inserted through these aligned apertures with the opposing prongs being pinched against the hasp as it is being inserted through the apertures. Once through the apertures the prongs return to their original positions thus preventing withdrawal of the hasp end from the apertures.

The fastening hasp is also formed to allow severance from the container sections to which it is permanently attached. That is, the hasp is not removed from the aligned apertures but formed with at least a first crosswise scoring which is torn by pulling upon the hasp. In accordance with a more preferred embodiment this scoring is located to allow severance of the hasp at an end opposite that end inserted into the aligned apertures. That is, the hasp is scored across its width along its juncture to the container cover or base to which it is attached. When the hasp tab is grasped and pulled, the hasp will tear along this scoring.

More specifically, a container having two such fastening hasps in accordance with an embodiment of the invention is seen generally in FIGS. 1 and 2 at 20, with each of such fastening hasps being seen generally at 22 and 24.

The container 20 is defined by a cover 26 and a base 28. Both the cover 26 and base 28 are box-like structures defined by four peripheral side walls connected to a single wall. The cover 26 is further formed with a ridge 30 which runs around the outer periphery of the side walls. The base 28 is formed with a peripheral cuff 32 as defined by four peripheral walls. The peripheral walls of the cuff 32 while being generally parallel to the four peripheral walls defining the base 28, are displaced further outward.

The construction of the base cuff 32 defines a seat, seen generally at 34, upon which the side walls of the cover 26 rest when such cover 26 is positioned upon the base 28. The cuff 32 is dimensioned such that the peripheral walls of the cover 26 fit snugly between such walls and upon the seat 34. Further the ridge 30 of the cover 26 will rest upon the top edges of the cuff 32 side walls when the cover 26 is positioned upon the base 28. This construction ensures a tight fit between the cover 26 and the base 28, as better seen in FIG. 2, which minimizes lateral movement of the cover 26 with respect to the base 28.

In accordance with that embodiment of the invention seen in the FIGS. 1 and 2, the container 20 is constructed with a plurality of flat hemispherically shaped lips 36 which extend up from the base 28 seat 34, that is from the top portions of the peripheral side walls defining the base 28. These lips 36 are spatially separated from the walls defining the cuff 32 and are so positioned so that the edges of the cover 26 peripheral walls fit between the lips 36 and the peripheral walls defining the cuff 32. This arrangement further minimizes any lateral movement of the cover 26 with respect to the base 28.

As stated the container 20 is formed such that one wall of the cover 26 will be positioned adjacent to one wall of the base 28 when the cover 26 and base 28 are fitted together. Each of these adjacently disposed walls will be formed with apertures which will be aligned when the cover 26 and base 28 are fitted together.

In accordance with the embodiment illustrated in FIGS. 1 and 3, the cover 26 is formed with two side wall extensions 56 and 58 which project downward from opposite peripheral side walls. Each extension 56 and 58 includes an aperture, seen respectively at 60 and 62. The extensions 56 and 58 extend downward at a location along the respective side walls to pass through appropriately located upwardly facing apertures formed through the seat 34 of the base 28, with each of such apertures respectively seen at 64 and 66 in FIG. 3. These side walls further include holes 68 and 70 located directly below the apertures 64 and 66. Each of these holes 68 and 70 are properly located so that when the respective extensions 56 and 58 are seated therethrough the apertures 64 and 66 and the apertures 60 and 62 will be in alignment with holes 68 and 70.

The container 20 further includes two fastening hasps 22 and 24. Specifically, each of such fastening hasps 22 and 24 are permanently attached at one end to the base 28. More specifically, the hasps 22 and 24 can be integrally formed with the container 20 when such container is being formed by a known injection molding technique. Thus the hasps 22 and 24 are integrally formed with the base 28.

The second opposite end of the fastening hasps 22 and 24 are constructed to allow passage of this end through the aligned apertures of the overlapping side walls of the cover 26 and base 28 that is apertures 60 and 62 of extensions 56 and 58 which are respectively aligned with holes 68 and 70. This end is however constructed to limit withdrawal from these apertures once properly placed therethrough. In particular, this end of the hasps 22 and 24 is formed to pass only in a first direction through the aligned apertures.

More specifically, each fastening hasp 22 and 24 includes a body 38 which is typically formed from a flexible material, such as a plastic. When integrally formed by an injection molding technique the entire container 20, as well as the hasps 22 and 24 are formed from a flexible plastic. If the hasps 22 and 24 are not formed from a flexible body, such as when the hasps 22 and 24 are secured to the base 28 after the container 20 is constructed, the hasp body is formed with one or more appropriately located joints. Thus even if the hasp body is not formed from a flexible plastic, the joints will allow a degree of flexibility.

In the illustrated embodiment each fastening hasp 22 and 24 is formed with two joints, seen generally at 40 and 42 in fastening hasp 22. Joint 40 lies at the juncture of the fastening hasp 22 to the cuff 32 wall, while the joint 42 lies mid way along the length of fastening hasp 22.

More specifically, the fastening hasp includes a tab portion 44 and snap lock portion 46, both of which portions will be discussed more fully. Joint 40 lies between the tab portion 44 and the cuff 32, while joint 42 lies between the tab portion 44 and snap lock portion 46. This construction of the fastening hasps 22 and 24 allows flexibility, even if such fastening hasps 22 and 24 are not constructed from a flexible material. Further, as will be described more fully herein, the joints 40 and 42 serve a second function, that being points at which the fastening hasp 22 can be torn away from the cuff 32.

The snap lock portion 46 is defined by a body 38 which is secured to the tab portion 44 by the joint 42 and a neck segment 50 which extends out from the body 38. This neck segment 50 extends out from and is of a narrower width than such body 38. Furthermore, the neck segment 50 is formed with two prongs 52 and 54. These prongs 52 and 54 are integral with and extend out from a common end 72 of the neck segment 50. Generally, this common end 72 is disposed opposite the body 38. Each of the prongs 52 and 54 extend out from this common end 72 and lie generally parallel to the neck segment 50. Thus the combination of the neck segment 50 and the prongs 52 and 54 defines a three fingered fork, with the middle finger, that is the neck segment 50 attached to the body 38.

The prongs 52 and 54 are also spatially separated from the neck segment 50, except where joined together at the common end 72. This physical separation allows the prongs 52 and 54 to move towards and away from the neck segment 50 by the application of a force against the outer edges of each prong 52 and 54. The importance of this feature of the snap lock portion 46 will become apparent.

As also illustrated the prongs 52 and 54 flare outward from the common end 72. More specifically, the width of each prong 52 and 54 flares outward in a direction away from the common end 72. The resulting prongs 52 and 54 thus define with their respective outer edges an angle with respect to each other, which angle is not critical to the invention.

However, the prongs 52 and 54 should flare sufficiently outward to ensure that the width between the prongs 52 and 54 outermost edges gradually increases from the common end 72. This gradually increasing width should be such so that the overall width of the snap lock portion 46, with prongs 52 and 54 in their normal position, is initially smaller than the width of either of the aligned apertures, i.e. the aligned apertures 60 and 68, through which the snap lock portion 46 will be passed, while gradually increasing until it becomes larger than the width of either of such apertures.

However, the width of either of the prongs 52 and 54 should not be so large so as to prevent the passage of the snap lock portion 46 through the aligned apertures, i.e., 60 and 68. That is, when the prongs 52 and 54 move inwards towards the neck segment 50 by the application of pressure against their outer edges, the snap lock portion should be able to pass through the aligned apertures. That is, the spatial separation between each of the prongs 52 and 54, and the neck segment 50 should provide the tolerance to allow even the widest portion of the prongs 52 and 54 to pass through the aligned apertures 60 and 68. The importance of this feature of the snap lock portion 46 will be described more fully herein.

The hasp tab portion 44 is an elongated body which is secured only partially along one side to the cuff 32 side wall. Specifically, the tab portion 44 is secured to such wall by the joint 40. Thus part of the tab portion 44 is free from any attachment to the cuff 32 and can thus be grasped and pulled sufficiently away from the cuff 32 to tear away the hasp.

As stated, the hasps 22 and 24 of the invention are preferably formed with at least one cross-width scoring along which such hasp can be torn. In the illustrated embodiment the joints 40 and 42 double as this scoring.

When the tab portion 44 is grasped and pulled the hasp will tear along either or both of the joints 40 and 42. It should be noted that the hasps may be formed with scoring other than the joint 40. For that matter, the hasps can be formed without such joints and instead include any type of scoring, e.g., perforations formed along both or one side of the tab portion 44.

As stated the snap lock portion 46 is formed such that the common end 72 will pass through the aligned apertures 60 and 68. As the snap lock portion 46 is passing through such apertures, the outermost edges of the prongs 52 and 54 will engage the aperture defining walls by pushing the snap lock portion 46 further through the aligned apertures and a force is applied against these outermost edges causing the prongs 52 and 54 to move inward towards the neck segment 50. The continued movement of the snap lock portion 46 sufficiently moves the prongs 52 and 54 inward to allow passage through the apertures.

However, once the snap lock portion 46 is pushed completely through the aligned apertures, the prongs 52 and 54 return to their original positions. If an attempt is made to withdraw the snap lock portion 46 from the aligned apertures, those ends of the prongs 52 and 54 opposite the common end 72, which ends are seen generally at 53 and 55, will come to bear against the defining walls and prevent movement back through such apertures 60 and 62.

In particular the operation of the hasps and in particular the snap lock portion 46 will be described in greater detail with reference to FIGS. 4A through 4D. The snap lock portion 46 is seen in its original condition in FIG. 4A, that is, the portion 46 is illustrated prior to being inserted through the apertures 60 and 68.

Each of the fastening hasps 22 and 24 are flexed as seen in FIG. 4 B with the respective snap lock portion 46 inserted through the aligned apertures 60 and 68. As stated the snap lock portion 46 includes a neck segment 50 which is integrally formed at the common end 72 with the prongs 52 and 54. The snap lock portion 46 is inserted by the common end 72 through the aligned apertures, for example, the aligned pair of apertures 60 and 68, as seen in FIG. 3. As the prongs 52 and 54 are passing through the aligned apertures 60 and 68 they are inwardly moved as their respective outermost edges engage the aperture defining walls.

By continuously pushing the snap lock portion 46 through the aligned apertures, as seen in FIGS. 4 B and 4 C, the respective prongs 52 and 54 are inwardly moved allowing passage of the snap lock portion 46 through the apertures 60 and 68. Once through the aligned apertures 60 and 68, prongs 52 and 54 snap back or return to their original positions, as better seen in FIG. 4D.

If an attempt is made to withdraw the snap lock portion 46, the ends 53 and 55 of each respective prong 52 and 54 will engage the aperture defining walls as seen in FIG. 4 D. That is, when the snap lock portion 46 is being pulled back out of the apertures, these ends 53 and 55 will engage such walls preventing the removal of the snap lock portion 46 from the apertures 60 and 68. Since the prongs 52 and 54 are now positioned within the container 20, and not accessible from outside the container 20, the removal of the fastening hasps 22 and 24 is prevented.

There will be circumstances when it will be desirable to gain entrance into the container 20. The operation of the removal of the hasps from the cuff 32 will be described with reference to FIG. 5. In particular, the tab portion 44, which is affixed to the cuff 32 along only a small portion by the joint 40 is grasped and pulled out from the container 20. The joint 40, which as stated doubles as the scoring, is torn as the tab portion 44 is pulled away from the container 20. Furthermore, by continually pulling on tab portion 44 the joint 42 is also torn away.

It is thus an important feature of the invention that the fastening hasps 22 and 24 be constructed to not only lock the container closed, but also be constructed to facilitate the opening of the container 20. This last requirement is satisfied by the combination of the tab portion 44 and scoring the hasp along its width at a location which will tear when the tab portion 44 is sufficiently pulled.

It should be noted that single fastening hasps may be included along opposite container sides, or more than one such fastening hasp may be included along each container side, or single hasps included along each container side. Any suitable arrangement may be provided for one or more hasps.

The container 20 may also be formed with eyelets, such as seen at 96 and 98 in FIG. 1, which project out from the cover 26 and base 28 respectively. These eyelets 96 and 98 are arranged to be brought into alignment when the cover 26 and base 28 are fitted together. A standard wire or plastic tie, not shown, can be drawn through the aligned eyelets 96 and 98 and sealed together in accordance with known techniques. That is, the ties may be sealed together using wax or solder in accordance with known techniques for providing an additional measure of sealing the container 20.

In accordance with another preferred embodiment a plastic strip, not shown, is used to seal the container 20 using the eyelets 96 and 98. A first end of this plastic strip is formed with an aperture through which the strip length is pulled by a second opposite strip end. Furthermore, this plastic strip has formed along its length one way barbs, which barbs are dimensioned and formed to pass in only one direction through the aperture. As the strip length is pulled through the aperture those barbs having passed through the aperture prevent withdrawal back therethrough. This thus prevents removal of the strip from the eyelets. Thus entrance is gained into the container 20 only by removing the hasps of the invention, but also by removing the ties, with removal of either the hasps or the ties being visually observable.

Another embodiment of the invention is illustrated in FIG. 6. In this embodiment the container, seen generally at 80, includes a base 82 joined along one side by a hinge joint 84 to a cover 86. The cover 86 is generally a flat top cover, as compared to the cover 26 illustrated in FIGS. 1, 2, 3 and 5.

The container 80 also includes a single fastening hasp 88, which is formed as described above. This hasp 88 can be positioned through aligned apertures with only aperture 90 of wall extension 92 seen. The operation of the hasp 88 is as described above for the hasps illustrated in FIGS. 1–5.

The container 80 further includes two pairs of alignable eyelets, with the first pair being eyelets 100 and 102, and the second pair being eyelets 104 and 106. Each pair of eyelets is located adjacent to one of the corners of the base 82 and cover 86. When a tie, not shown, as described above is inserted through the aligned apertures of each of the eyelet pairs the container is effectively locked against unwanted tampering.

While the preferred embodiment has been described and illustrated, various substitutions and modifications may be made thereto without departing from the scope of the invention. Accordingly, it is to be understood that the present invention has been described by way of illustration and not limitation.

What is claimed is:

1. A device comprising:

a container defined by a cover and a base which can be fit together, said cover and said base each being formed with at least one wall which is placed adjacent to a wall of the other when said cover and base are fitted together, each of said adjacently disposed walls being formed with apertures which are brought into alignment when said walls are positioned adjacent to one another by the fitting of the cover and base together; and at least a first hasp means attached at one end to either said cover or said base, said hasp means having a second end to which is affixed a resiliently deflectable means, said deflectable means including a portion thereof which projects out along side said hasp means and is movable towards said hasp means to allow passage through said aligned apertures and which is movable away from said hasp means once through said aligned apertures to prevent removal therefrom, said hasp means further formed with a severance means which can be grasped and pulled to cause the tearing of a portion of said hasp means away from said container.

2. The device of claim 1 wherein said severance means comprises forming said hasp body with a tab portion located adjacent said first end which can be gripped and pulled to sever said hasp body from said container.

3. The device of claim 2 wherein said tab portion defines an edge which is partially affixed to said container, said hasp body being severed from said container along said edge.

4. The device of claim 2 wherein said tab portion defines an edge which is partially affixed to said container, said edge further defining a scoring along which said hasp body is severed from said container.

5. The device of claim 2 wherein said tab portion is partially affixed along one side to said container by a joint and affixed to the remainder of said hasp means by a second joint, which joints are torn by grasping and pulling upon said hasp tab portion.

6. The device of claim 2 wherein said cover and base are joined together along a first edge by a hinge joint.

7. A device comprising:

a container defined by a cover and a base which can be fit together, said cover and said base being a box like structure as defined by four peripheral walls connected to a common wall, said cover and said base being formed to ensure that at least one of said peripheral walls of cover becomes positioned adjacent to one of said peripheral walls of said base when said cover and base are fitted together, each of said adjacently disposed peripheral walls being formed with apertures which are brought into alignment when said peripheral walls are positioned adjacent to one another by the fitting of the cover and base together; and at least a first hasp means being affixed at one end to either said cover or said base, said hasp means being defined by a flexible body having a second opposite end which can be directed through said aligned apertures, said hasp means second end having two prong means affixed at opposing sides thereof, each of said prong means including a portion thereof which projects out along side and is spatially separated from said hasp means, each of said prong means being independently operable for movement towards said hasp means to allow passage through said aligned apertures and being movable away from said hasp means once through said aligned apertures to prevent removal therefrom, said hasp means further formed with a severance means which can be grasped and pulled to cause the tearing of a portion of said hasp means away from said container.

8. The device of claim 7 wherein each of said prong means is defined by a body which is attached at a first end to said hasp means second end and which remains spatially separated and disposed along side said hasp means, said hasp means second end in combination with said prong means defining a cross-sectional width larger than a cross-sectional width of either of said aligned apertures, with each of said prong means body being movable in a first direction towards said hasp means to allow passage of said second end through said aligned apertures, said prong means body being resiliently movable in a second opposite direction away from said hasp means after passage through said apertures to prevent removal therefrom.

9. The device of claim 7 wherein said movement in said first direction is affected by the engagement of each of said prong means against said peripheral wall defining said aperture as said second end is being passed therethrough, which engagement exerts a force against said prong means forcing said movement, with passage of said prong means through said apertures causing the removal of said force to allow said prong means to move in said second opposite direction and prevent removal of said second end from said apertures.

10. The device of claim 9 wherein said severance means comprises forming said hasp body with a tab portion located adjacent said first end which can be gripped and pulled to sever said hasp body from said container.

11. The device of claim 10 wherein said tab portion is partially affixed along one side to said container, said hasp body being severed from said container along said side.

12. The device of claim 10 wherein said tab portion is partially affixed along one side to said container, said side being defined by a scoring along which said hasp body is severed from said container.

13. The device of claim 10 wherein said tab portion is partially affixed along one side to said container by a joint and along an opposite side to prong bearing portion of said hasp by a second joint, said hasp being severable along either of said joints.

14. The device of claim 10 wherein said tab portion is partially affixed along one side to said container and along an opposite side to prong bearing portion of said hasp, with each of said sides being scored, said hasp being severable along either of said scored sides.

15. The device of claim 14 wherein said cover and base are joined together along a first edge by a hinge joint.

16. A device comprising:

a container defined by a cover and a base which can be fit together, said cover and said base being a box like structure as defined by four peripheral walls connected to a common wall, said peripheral walls of said cover being dimensioned to fit within said peripheral walls of said base, at least one of said peripheral walls of said cover being positioned adjacent to one of said peripheral walls of said base when said cover and base are fitted together, each of said adjacently positioned peripheral walls being formed with apertures which are brought into alignment when said peripheral walls are positioned adjacent to one another by the fitting of the cover and base together; and at least a first hasp means formed with a tab portion and a prong portion, with said tab portion and said prong portion being joined along a hinged joint, said tab portion being affixed along that side opposite said hinged joint to a peripheral wall of either said cover or said base to allow grasping thereof, which point of affixment of said tab portion is scored, said prong portion being defined by a body narrower that said tab portion to which is affixed on opposite sides two arms, each of said arms including a body portion which is unattached and spatially separated from said body to define a width gradually increasing in a direction away from the attached area larger than the width of either of said apertures, said arms being movable towards said body by the application of force against such arm to allow passage of said arms through said aligned apertures, with said arms resiliently moving in an opposite direction when said force is removed preventing the withdrawal of said arms through said aligned apertures; and wherein said hasp means is severed from said container by grasping and pulling of said tab portion away from said container to cause a tear along said scoring.

17. The device of claim 16 wherein said scoring is defined by a hinged joint connecting said tab portion to said container.

18. The device of claim 17 wherein said base peripheral walls define a seat upon which said peripheral walls of said cover can be rested.

19. The device of claim 18 wherein said base peripheral walls defining said seat are further formed with upwardly projecting lips which are spatially separated from said peripheral walls to define an area which receive said cover peripheral walls.

20. The device of claim 19 wherein said arms are integrally formed with that end of said prong body opposite said tab portion, each of said arms project rearward from and in a substantially parallel direction to said prong body.

21. The device of claim 20 wherein said device comprises two hasp means positioned at opposite sides of said box like structure.

22. The device of claim 21 wherein said cover and base a joined along a common side by a hinged joint.

* * * * *